US006701975B1

(12) United States Patent
Neal

(10) Patent No.: US 6,701,975 B1
(45) Date of Patent: Mar. 9, 2004

(54) LID ASSEMBLY

(75) Inventor: Stanley D. Neal, Mt. Juliet, TN (US)

(73) Assignee: Campbell Hausfeld/Scott Fetzer Company, Harrison, OH (US)

( * ) Notice: Subject to any disclaimer, the term of this patent is extended or adjusted under 35 U.S.C. 154(b) by 0 days.

(21) Appl. No.: 10/267,564

(22) Filed: Oct. 9, 2002

(51) Int. Cl.[7] ..... B67D 5/60
(52) U.S. Cl. ..... 141/18; 141/20.5; 222/464.1
(58) Field of Search ..... 141/18, 20.5, 29; 222/382, 464.1–464.7; 401/144, 187

(56) References Cited

U.S. PATENT DOCUMENTS 3,285,478 A * 11/1966 Gordon ..... 222/416
3,304,573 A 2/1967 Stefely
3,630,418 A * 12/1971 Bilichniansky ..... 222/334
4,424,011 A 1/1984 O'Brien et al.
4,540,301 A 9/1985 Swanson et al.
4,552,477 A 11/1985 Braithwaite et al.
4,588,318 A 5/1986 O'Brien et al.
4,611,941 A 9/1986 Karliner et al.
4,639,156 A 1/1987 Stern et al.
4,695,176 A 9/1987 Simonette et al.
4,909,409 A 3/1990 Shreve
5,497,945 A * 3/1996 Steinberg et al. ..... 222/464.1
5,975,782 A 11/1999 Lee

* cited by examiner

*Primary Examiner*—Gregory Huson
*Assistant Examiner*—Peter deVore
(74) *Attorney, Agent, or Firm*—Jones Day

(57) ABSTRACT

A lid assembly for a paint reservoir includes a lid, a first rigid suction tube, and a second rigid suction tube. The lid includes a cover member and a flange that extends downwardly from the periphery of the cover member. A suction opening, vent hole opening, and bypass opening extend axially through the cover member. A first tubular member is positioned in the suction opening and a second tubular member is positioned in the bypass opening. The first suction tube extends through the first tubular member. The second suction tube is coupled to and extends downwardly from the first suction tube. The second suction tube is configured to extend near the bottom surface of the paint reservoir.

17 Claims, 3 Drawing Sheets

LID ASSEMBLY

FIELD OF THE INVENTION

The claimed invention relates to a lid assembly. In particular the invention relates to a lid assembly for use on a paint can or fluid reservoir.

BACKGROUND

Airless paint sprayers use a paint cup that is attached to the sprayer housing, or an accessory hose that extends from the paint sprayer housing to a paint can or fluid reservoir. With the latter, paint in the reservoir is suctioned into the paint sprayer through a hose that extends from the sprayer housing into the reservoir. Paint is pumped from the reservoir, through the accessory hose, through the housing, and out the nozzle of the sprayer for application of the paint to a surface. It is desirable that the end of the hose is positioned at the bottom of the reservoir so that all the paint may be suctioned from the reservoir during use.

Hoses that are conventionally provided as an accessory with airless paint sprayers are shipped in the same box as the paint sprayer. In order to fit the hose in the box, the hose is coiled. The hose oftentimes takes on a coiled shape and rebounds to this coiled shape even when unwound. Hoses often coil upwardly so that the end of the hose is no longer positioned at the bottom of the reservoir. As a result, positioning the coiled end of the hose at the bottom of a paint reservoir may be problematic. Hoses often coil upwardly so that the end of the hose is no longer positioned at the bottom of the reservoir. Various devices have been utilized to solve this problem, such as a clip that may be positioned on the side of a paint can and that holds the hose in position near the bottom of the can.

SUMMARY

The claimed invention concerns a lid assembly for a paint reservoir. The lid assembly includes a lid, a first rigid suction tube, and a second rigid suction tube. The lid is configured to couple to and cover an opening of a paint reservoir and includes a cover member having an upper surface and a lower surface, and a flange extending downwardly from the periphery of the cover member. The cover member also includes a suction opening and a vent opening that extend axially through the cover member. The suction opening includes a first tubular member that extends downwardly from the cover member.

The first suction tube extends through the first tubular member so that an upper end of the first suction tube extends above the upper surface of the cover member and a lower end of the first suction tube extends below the lower surface of the cover member. The second suction tube is coupled to and extends downwardly from the first suction tube, and is configured to extend near a bottom surface of the paint reservoir. A filter may be coupled to a lower end of the second suction tube.

The cover member may also include a bypass opening that extends axially through the cover member. The bypass opening comprises a second tubular member that extends upwardly from the upper surface of the cover member. A bypass hose may be coupled to the second tubular member and a suction hose may be coupled to the upper end of the first suction tube. In one embodiment, the cover member is disc-shaped and may be circular.

BRIEF DESCRIPTION OF THE DRAWING FIGURES

DETAILED DESCRIPTION

Figure 1:
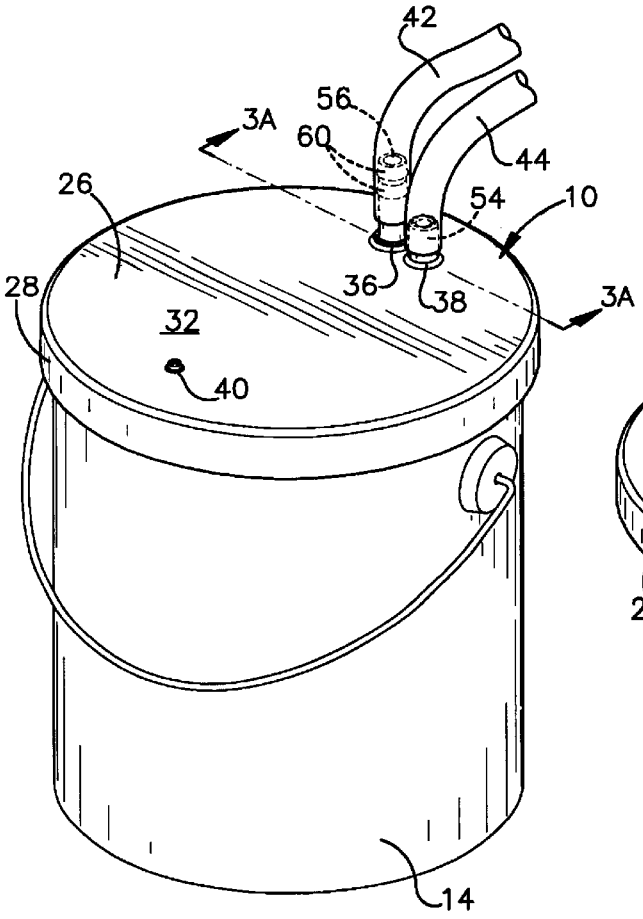
FIG. 1 is a perspective view of a paint can with a bucket lid assembly of the claimed invention installed on a rim of the can.
Figure 2:
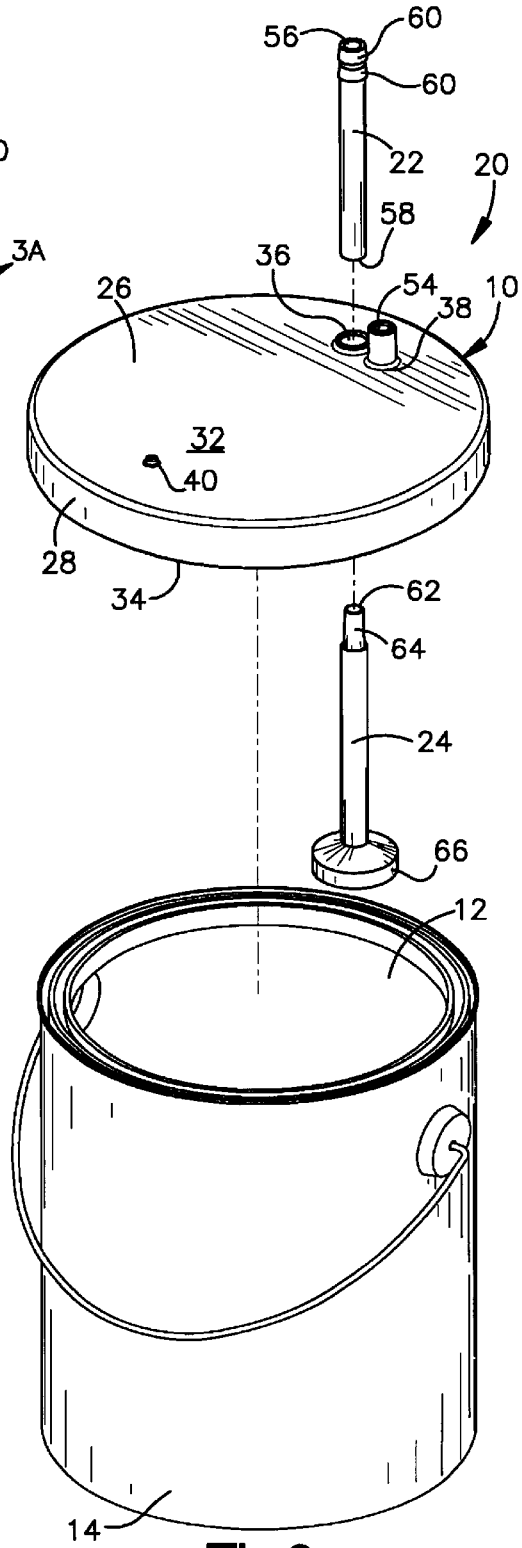
FIG. 2 is an exploded perspective view of the various parts of the assembly shown in FIG. 1.

A bucket lid 10 is a covering positioned over an opening 12 of a paint reservoir 14, such as a paint can. The lid 10 engages the opening 12 of the paint reservoir 14 and assists in deterring the spillage of paint from the reservoir 14 during use. The lid 10 preferably prevents leakage of paint from the reservoir 14 under numerous conditions, such as normal use, kicking of the paint reservoir 14, tipping of the paint reservoir 14, and the like.

As shown in FIGS. 1–3A, the bucket lid assembly 20 of the present invention includes a lid 10, a first suction tube 22, and a second suction tube 24. The lid 10 is formed from a cover member 26 and a flange 28 that extends downwardly around the outer periphery of the cover member 26. The cover member 26, in a preferred embodiment, is disc-shaped, and, in an even more preferred embodiment, is circular. The flange 28 is designed to engage the exterior wall of a paint reservoir 14, such as the paint can shown in FIG. 1. In addition, the flange 28 has an inwardly extending lip 30 that is positioned near the bottom of the flange 28. The lip 30 and flange 28 are configured to engage the paint reservoir 14 in a fluid-tight manner such that if the paint reservoir 14 is tipped, paint will not flow between the reservoir opening 12 and the flange 28. When the cover member 26 is circular, the flange 28 is cylindrical.

The lid 10 may be formed in a number of different shapes and sizes depending upon the size and shape of the opening 12 of the paint reservoir 14. For instance, one lid may have a diameter to fit on a quart-size paint can while another lid may have a diameter to fit a gallon size paint can.

The cover member 26 has an upper surface 32 and a lower surface 34. Several openings extend through the cover member 26, including a suction opening 36, a bypass opening 38, and a vent opening 40. The suction opening 36 is utilized with the first and second suction tubes 22, 24, which are coupled to a suction hose 42 that extends to a paint sprayer or similar device. The suction tubes 22, 24 are utilized to suction paint from the paint reservoir 14 to the paint sprayer. The bypass opening 38 is coupled to a bypass hose 44 of the paint sprayer and is used to return paint to the paint reservoir 14 that is not sprayed through the nozzle of the paint sprayer. The vent opening 40 is used as a vent to allow air to replace paint as the paint is suctioned from the paint reservoir 14.

As shown in FIG. 1, the suction 36, bypass 38, and vent 40 openings are positioned near the outer periphery of the cover member 26. In particular, the vent opening 40 is positioned diametrically across from the suction and bypass openings 36, 38, and the bypass and suction openings 36, 38 are positioned adjacent one another. Alternatively, the openings 36, 38, 40 can be positioned at other locations on the cover member 26, if so desired.

Figure 3A:
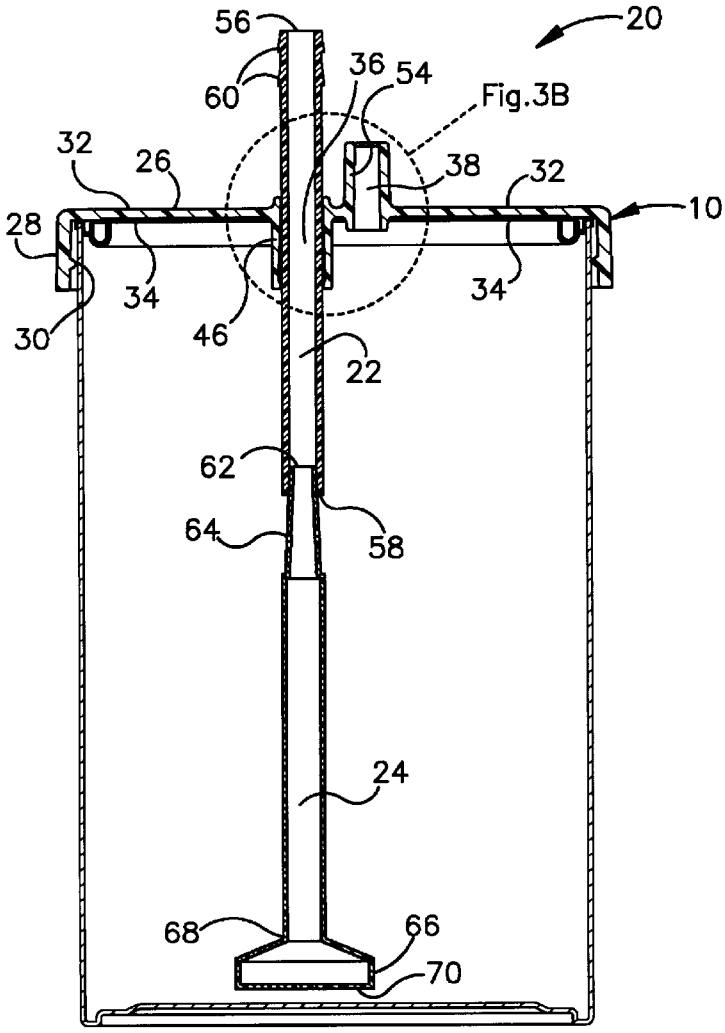
FIG. 3A is a cross-sectional view of the lid assembly taken at line 3A—3A in FIG. 1.
Figure 3B:
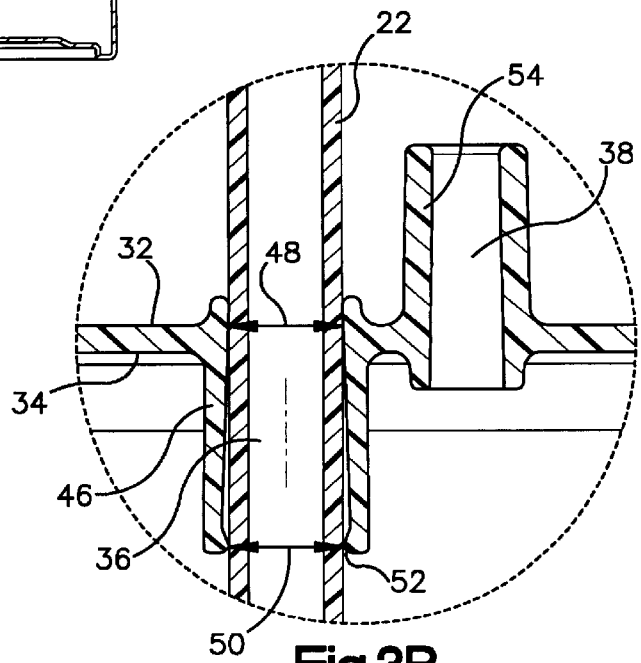
FIG. 3B is an expanded view of the circled area shown in FIG. 3A.

The suction opening 36 includes a first tubular member 46 positioned in the opening 37. The first tubular member 46 extends downwardly from the lower surface 34 of the cover member 26. As shown in FIG. 3A, part of the first tubular member 46 may also extend above the upper surface 32 of the cover member 26. The first tubular member 46 engages the first suction tube 22, which is inserted through the first tubular member 46.

The first tubular member 46 may be cylindrical or frustoconical. In a preferred embodiment, shown in FIG. 3B, the first tubular member 46 is frustoconical and has a first diameter 48 at the upper end of the member 46 that is larger than a second diameter 50 at the lower end of the member 46, although it may have other shapes and sizes. The tapered opening of the first tubular member 46 is used to grasp the first suction tube 22 when it is inserted into the opening 36. In addition, a lip 52 extends inwardly at the lower end of the first tubular member 46. The lip 52 along with the taper grasps the first suction tube 22 when it is inserted into the first tubular member 46 to create a fluid tight engagement, or a nearly fluid tight engagement. The first tubular member 46 is dimensioned such that if the paint reservoir 14 is tipped over, paint will be deterred from flowing between the first suction tube 22 and the first tubular member 46 to escape from the paint reservoir 14.

A second tubular member 54 is positioned in the bypass opening 38 and extends upwardly from the cover member's upper surface 32. A portion of the second tubular member 54 may also extend below the lower surface 34 of the cover member 26, as shown in FIG. 3A. The second tubular member 54 is preferably cylindrical or frustoconical, although it may have other shapes. In addition, the diameter of the second tubular member 54 is preferably similar to that of the first tubular member 46. The second tubular member 54 has a diameter that is compatible with a bypass hose 44. An open end of a bypass hose 44 is preferably positioned around the second tubular member 54 in fluid-tight engagement, as shown in FIG. 1. The free end of the bypass hose 44 is then connected to a paint sprayer or similar device. Paint that bypasses the pump unit in the paint sprayer is returned to the paint reservoir 14 through the bypass hose 44 and the second tubular member 54.

As shown in FIG. 3A, the cover member 26, flange 28, first tubular member 46, and second tubular member 54 are integrally formed as one piece as the lid 10 of the assembly 20. In a preferred embodiment, the material of the lid 10 has some flexibility for assisting in grasping a paint reservoir 14. A preferred material for the lid is polyethylene, although other materials may also be utilized. The lid 10 may alternatively be made of a generally rigid material.

The first suction tube 22 is a cylindrical rigid tube that extends through the first tubular member 46 such that an upper end 56 of the tube 22 is positioned above the upper surface 32 of the cover member 26 and a lower end 58 of the tube 22 is positioned below the lower surface 34 of the cover member 26. Several ridges 60 are positioned around the upper end 56 of the first suction tube 22 and are utilized to adjoin the upper end 56 of the first tubular member 46 to a suction hose 42 and to maintain the hose 42 in coupled relation with the first suction tube 22.

The second suction tube 24 is coupled to the lower end 58 of the first suction tube 22. In a preferred embodiment, the second suction tube 24 has an inner diameter that is equal to an inner diameter of the first suction tube 22, although the diameters may be different. The upper end 62 of the second suction tube 24 includes a tapered portion 64 for insertion into the lower end 58 of the first suction tube 22. The upper end 62 of the second suction tube 24 is tapered in order to seat firmly within the lower end 58 of the first suction tube 22. Preferably, the second suction tube's association with the first suction tube 22 is fluid tight such that liquid and air cannot leak out or enter between the two tubes 22, 24. A fluid tight relationship also assists in suctioning since air cannot enter at the joint between the first and second suction tubes 22, 24.

The second suction tube 24 is shown in the drawings as having a length that is similar to the length of the first suction tube 22. However, the second suction tube 24 may have a length that is different from the first suction tube 22. For instance, different length suction tubes can be used for different sized paint cans. A shorter second suction tube 24 would be used with a quart paint can than with a gallon paint can. Moreover, the length of the second suction tube 24 can be selected based upon the height of the paint reservoir 14 being utilized. Differently sized lids 10 may also be utilized so that the assembly 20 is usable with different size paint cans or reservoirs.

A filter 66 is shown positioned at the lower end 68 of the second suction tube 24. The filter 66 includes a larger diameter portion that has a screen 70 that prevents debris from entering the second suction tube 24. The size of debris that is deterred from entering the second suction tube 24 is a function of the size of the screen openings. Large pieces of debris are preferably deterred from entering the second suction tube 24 since such large pieces could cause blockage of the suction hose 42, or damage to the paint sprayer.

Figure 5:
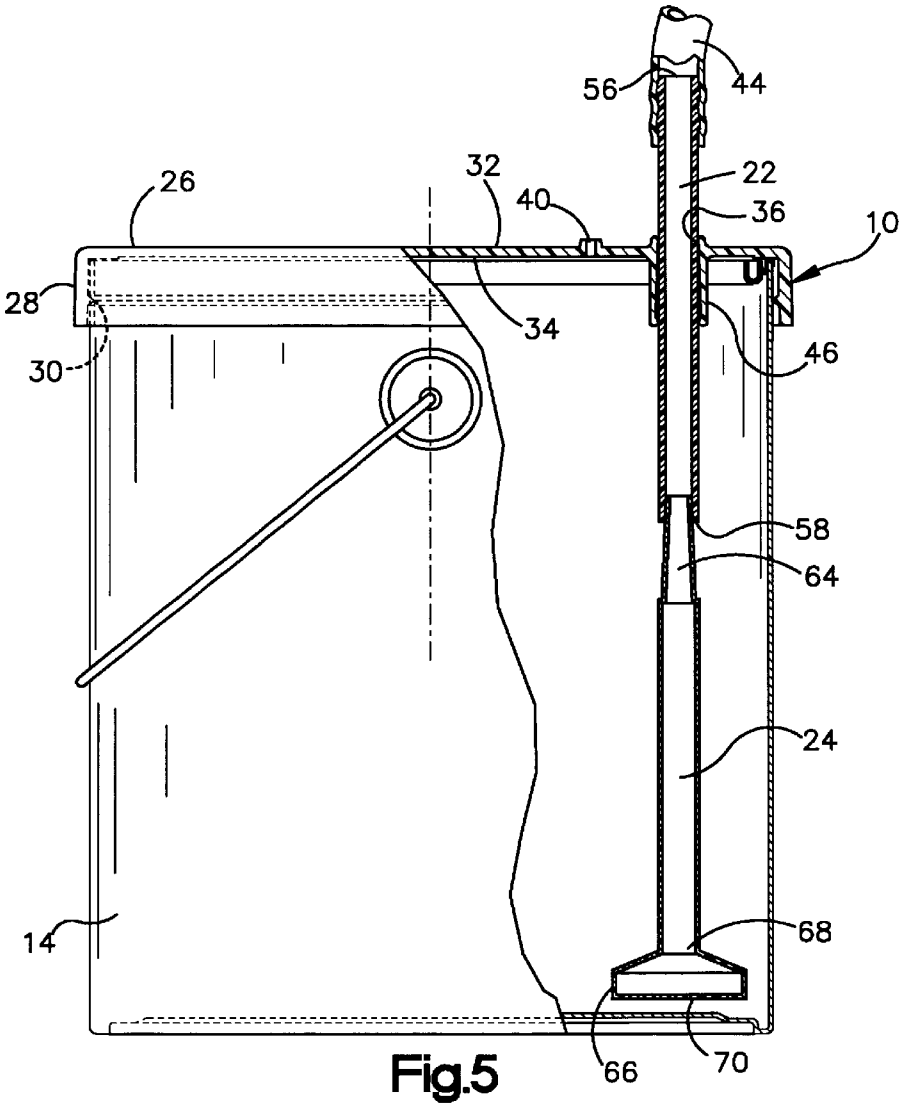
FIG. 5 is a cross-sectional side view of the lid assembly take at line 5—5 of FIG. 4, with the lid assembly installed on a paint can.
Figure 4:
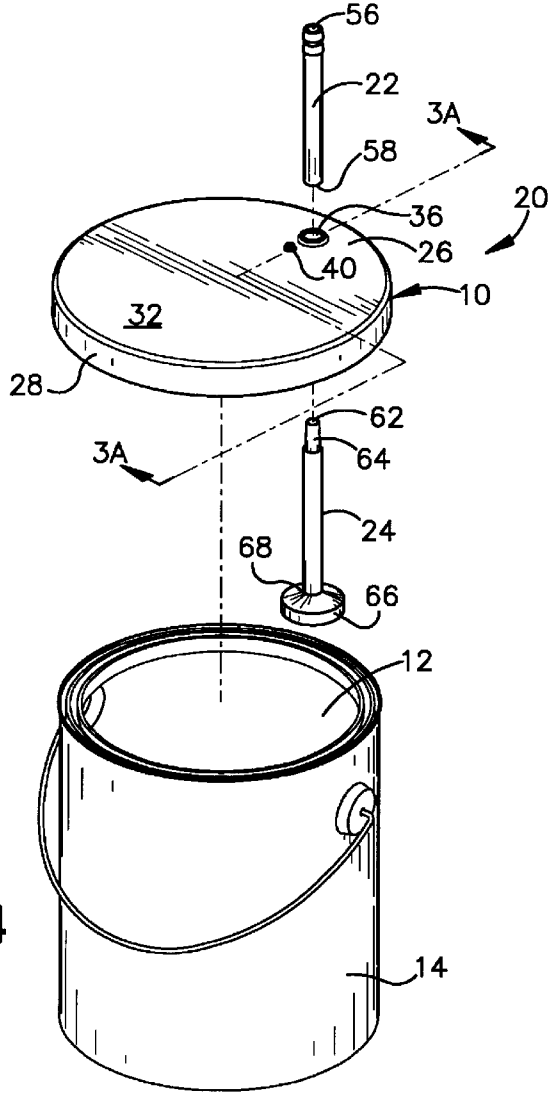
FIG. 4 is an exploded perspective view of an alternative embodiment of the bucket lid assembly.

FIGS. 4 and 5 depict an alternative embodiment of the invention, where a bypass hose 44 is not utilized with the bucket lid assembly 20. Bypass hoses 44 are not always utilized with airless paint sprayers and the present bucket lid assembly 20 is useful with these types of paint sprayers, as well. As shown in FIG. 4, the bucket lid 10 includes a suction opening 36 defined by a first tubular member 46 for coupling to the first suction tube 22. The vent hole 40 is positioned adjacent the suction opening 36. The vent hole 40 may be positioned at other locations on the cover member 26. Furthermore, while the suction opening 36 is shown positioned near the outer periphery of the cover member 26, it may be positioned at other locations on the lid 10.

The cover member 26 has been depicted in the figures as circular. However, other shapes of cover members are also contemplated to be within the boundaries of the appended claims, the invention not being limited to a particular shape for the cover member 26.

While various features of the claimed invention are presented above, it should be understood that the features may be used singly or in any combination thereof. Therefore, the claimed invention is not to be limited to only the specific embodiments depicted herein.

Further, it should be understood that variations and modifications may occur to those skilled in the art to which the claimed invention pertains. The embodiments described herein are exemplary of the claimed invention. The disclosure may enable those skilled in the art to make and use embodiments having alternative elements that likewise correspond to the elements of the invention recited in the claims. The intended scope of the invention may thus include other embodiments that do not differ or that insubstantially differ from the literal language of the claims. The scope of the present invention is accordingly defined as set forth in the appended claims.

What is claimed is:

1. A lid assembly for a paint reservoir comprising:

a lid configured to couple to and cover an opening of a paint reservoir, said lid having a cover member with an upper surface and a lower surface, and a flange extending downwardly from the periphery of the lid, said cover member having a suction opening and a vent opening extending axially therethrough, the suction opening comprising a first tubular member extending downwardly from the cover member;

a first rigid suction tube extending through the suction tube tubular member such that an upper end of the first suction tube extends above the upper surface of the cover member and a lower end of the first suction tube extends below the lower surface of the cover member; and a second rigid suction tube coupled to and extending downwardly from the first suction tube, said second suction tube being configured to extend near a bottom surface of the paint reservoir.

2. The lid assembly of claim 1, wherein the first tubular member has a first diameter at its upper end and a second diameter at its lower end, with the first diameter being larger than the second diameter, and the first and second diameters are configured to grasp the first suction tube in fluid tight relation.

3. The lid assembly of claim 2, wherein the first tubular member includes an inwardly extending lip at its lower end.

4. The lid assembly of claim 1, wherein the second suction tube comprises an upper end and a lower end, with the upper end being coupled to the first suction tube and comprising a tapered portion configured for insertion into the lower end of the first suction tube, and a filter is coupled to the lower end of the second suction tube.

5. The lid assembly of claim 1, wherein at least one ridge is positioned at the upper end of the first suction tube for coupling to a suction hose.

6. The lid assembly of claim 1, wherein the cover member is disc-shaped.

7. The lid assembly of claim 6, wherein the flange of the lid comprises an inwardly extending lip that extends around the circumference of the flange for engaging an outer surface of a paint reservoir.

8. The lid assembly of claim 6, wherein the disc-shaped cover member is circular.

9. The lid assembly of claim 6, wherein the paint reservoir is a gallon paint can and the lid is dimensioned to engage a rim of the gallon paint can in fluid tight relation.

10. The lid assembly of claim 1, wherein the suction opening is positioned in the vicinity of an outer periphery of the cover member and the vent opening is positioned in the vicinity of the outer periphery of the cover member diametrically across from the suction opening.

11. The lid assembly of claim 1, wherein the cover member further comprises a bypass opening extending axially therethrough, the bypass opening comprising a second tubular member extending upwardly from the upper surface of the cover member.

12. The lid assembly of claim 11, further comprising a bypass hose coupled to the second tubular member and a suction hose coupled to the upper end of the first suction tube.

13. The lid assembly of claim 12, further comprising a clamp clamped around the suction hose and the upper end of the first suction tube for holding the suction hose and first suction tube in engagement.

14. The lid assembly of claim 11, wherein the suction opening is positioned adjacent the bypass opening in the vicinity of an outer periphery of the cover member.

15. The lid assembly of claim 1, wherein the vent opening has a diameter that is smaller than a diameter of the suction opening.

16. The lid assembly of claim 1, wherein the cover member and flange are flexible.

17. The lid assembly of claim 1, wherein the flange, cover member, and first tubular members are integral.

* * * * *